United States Patent [19]

Hingorany

[11] 3,962,063

[45] June 8, 1976

[54] SELECTIVE PLATING APPARATUS

[75] Inventor: Ashok R. Hingorany, North Attleboro, Mass.

[73] Assignee: Advanced Materials Systems, Inc., North Attleboro, Mass.

[22] Filed: Dec. 18, 1974

[21] Appl. No.: 533,816

[52] U.S. Cl. ..... 204/206; 204/15; 204/28; 204/207; 204/212; 204/224 R

[51] Int. Cl.[2] ..... C25D 19/00; C25D 17/00

[58] Field of Search ..... 204/15, 28, 206, 207, 204/224 R, 275, 212

[56] References Cited

UNITED STATES PATENTS

| | | | |
|---|---|---|---|
| 3,629,077 | 12/1971 | Gannoe | 204/207 X |
| 3,819,502 | 6/1974 | Meuldijk et al. | 204/206 |

*Primary Examiner*—John H. Mack
*Assistant Examiner*—A. C. Prescott
*Attorney, Agent, or Firm*—Salter & Michaelson

[57] ABSTRACT

Apparatus for continuously and selectively plating a stripe of metal onto a continuously moving metal strip, said apparatus comprising a hollow, rotatably mounted plating wheel having a peripheral slot extending around the circumfery thereof, said slot communicating with the interior of said wheel, and distribution means fixedly mounted within said wheel, said distribution means comprising an electrolysis chamber and a suction chamber, means for feeding an electrolyte solution to said electrolysis chamber, and means for applying negative pressure to the suction chamber, whereby when the metal strip to be plated is maintained in driving engagement with the periphery of said wheel, said strip covers said slot, said electrolysis chamber having anode means associated therewith, and said strip being connected as a cathode, whereby electrolyte passing through said electrolysis chamber is electroplated on the exposed inner surface of the strip, with excess electrolyte continuously being drawn off through said suction chamber.

9 Claims, 11 Drawing Figures

SELECTIVE PLATING APPARATUS

BACKGROUND AND SUMMARY OF THE INVENTION

It has long been desirable, and in many cases necessary, to somewhat apply a metal laminate, usually precious metal, to a strip of a different metallic material. For example, in the electronic industry, gold-plated components, such as semi-conductors, connectors, etc., are frequently used in order to impact certain desirable characteristics, such as electrical conductivity, corrosion resistance, etc., to the metal strip. Obviously, it is not economically feasible to make such components completely of gold, and hence the procedure has been to use a less expensive metal, to which the gold or other previous metal is applied.

There are numerous techniques by which a previous-metal laminate can be applied to a metallic strip. For example, the laminate can be applied by simply cladding the different metals together, by means of a conventional cold-rolled bonding process, or by the equally conventional technique of soldering and then rerolling. In addition, a precious-metal laminate can be applied by putting a layer of the metal in molten form on the base metallic strip. Perhaps the most desirable technique, however, and the technique with which the instant invention is concerned, is electroplating; this technique being particularly desirable, since the thickness of the plating can be effectively controlled, desired hardness and wear resistance can be obtained using only minor amounts of other metals, etc.

Although electroplating techniques are well known in the art, most are usable only where the entire base strip is to be plated on one or both sides. Where, however, a base metal strip is being plated with a previous metal, such as gold, for electronic uses, it is usually necessary that only one side of the strip be plated, and it is further normally necessary that the plating cover only a portion of one side of the strip. Expressed differently, in many cases the functional requirements are such as to be met by plating a relatively thin continuous stripe of precious metal onto one surface of the base metal strip. The present invention is directed to apparatus for continuously plating such a stripe on one side of a metal strip.

The basic concept employed in the present invention embodies use of a rotatably mounted, hollow plating wheel having a slot extending around the peripheral circumference of the wheel, said slot communicating with the interior of the wheel. Means are provided for maintaining the metal strip to be plated in driving engagement with at least a portion of the periphery of said wheel, said strip being wider than the width of the aforesaid slot and covering same, whereby a portion of the inner surface of the strip will be exposed to the interior of said wheel. Distribution means are provided within the wheel for directing a flow of electrolyte which is fed to the wheel against the exposed inner surface of the strip to effect plating of said exposed inner surface, it being understood that suitable anode means are associated with the wheel, and the metal strip is connected as a cathode in order to complete the electrolytic circuit.

The above concept, to the extent that it is described in the paragraph supra, is not novel, it being noted that a similar system is disclosed and described in Meuldijk et al. U.S. Pat. No. 3,819,502 dated June 25, 1974, which patent represents the closest prior art of which applicant is aware.

Although the wheel plating technique disclosed and described in the above-noted Meuldijk patent is reasonably effective, it does possess certain inherent disadvantages. Reference is made to the fact that in Meuldijk plating takes place through a substantially stationary pool of electrolyte liquid, thus reducing agitation and hence the rate at which plating takes place. In addition, in Meuldijk the electrolyte is introduced to the plating wheel by gravity, since a relatively small volume of electrolyte is continuously being exchanged, thus limiting the rate of introduction of electrolyte to the apparatus. This also lessens the rate at which the strip can be plated in Meuldijk.

The present invention, while utilizing the same basic wheel system as in Meuldijk, overcomes the above-discussed disadvantages of the latter, whereby a much higher plating rate can be effectively obtained. More specifically, in the present invention, fixed, monorotatable distribution means are mounted within the plating wheel, said distribution means defining separate electrolysis and suction chambers. Means are provided for continuously pumping electrolyte at a relatively high rate (higher than gravity) to the electrolysis chamber which directs the electrolyte against the exposed inner surface of the strip to effect electroplating of same in the same general manner as in Meuldijk. In addition, means are provided for applying a negative pressure to the suction chamber whereby excess electrolyte is immediately drawn off from the electrolysis chamber to the suction chamber from which it is evacuated to a reservoir for subsequent recirculation to the electrolysis chamber. The suction chamber is specifically designed so as to have no anode whereby no appreciable plating of the strip takes place at that location, but rather plating takes place only at the location of the electrolysis chamber. Since, however, excess electrolyte is immediately drawn away from the electrolysis chamber, plating never takes place through a standing pool of liquid, thus permitting more rapid plating. Preferably, the suction chamber is located generally at a 5 to 7 o'clock position; while a pair of oppositely disposed electrolysis chambers are generally located at 2 to 5 o'clock and 7 to 10 o'clock positions. By having the suction chamber so located between the electrolysis chambers, flow of electrolyte from the latter to the former is enhanced by gravity. Thus, the only place where a standing pool of liquid may exist at any time in the present apparatus is in the suction chamber; but since by specific design little or no plating is taking place at said location, the presence of such a standing pool does not affect the rate of plating. Also, since the suction chamber in the present apparatus rapidly exhausts relatively large amounts of electrolyte, a greater rate of exchange of electrolyte to and from the apparatus is permitted; whereby instead of using gravity feed for the electrolyte, the latter may be introduced at a higher rate by pump means, all of which further enhances the rate of plating achieved by this invention.

A further feature of the present invention is the provision of means for achieving a more effective line contact between the inner surface of the strip and the opposite edges of the peripheral slot whereby more effective engagement of the strip and the edges of the slot is achieved, this being important not only to obtain good definition of opposite sides of the plated stripe, but also to insure a proper seal, which is necessary to maintain the desired negative pressure in the suction chamber.

Still another feature of the present invention is the provision of a novel belt system for engaging and supporting the outer surface of the metal strip to be plated, said system being preferably used in those situations where auxiliary means are necessary to insure proper driving contact of the strip to be plated with the plating wheel, such as where the strip is too thin to carry the required back tension, or where the strip is too thick to conform properly against the circumference of the wheel.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
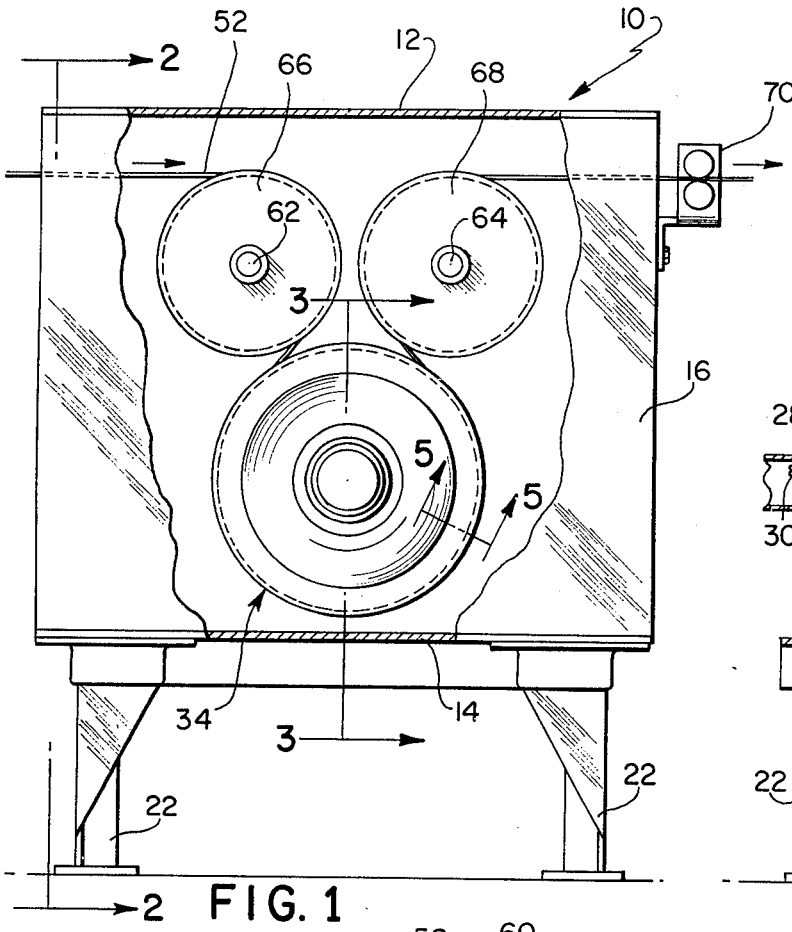
FIG. 1 is a side elevational view showing apparatus comprising the present invention, a portion being broken away for purposes of illustration.
Figure 2:
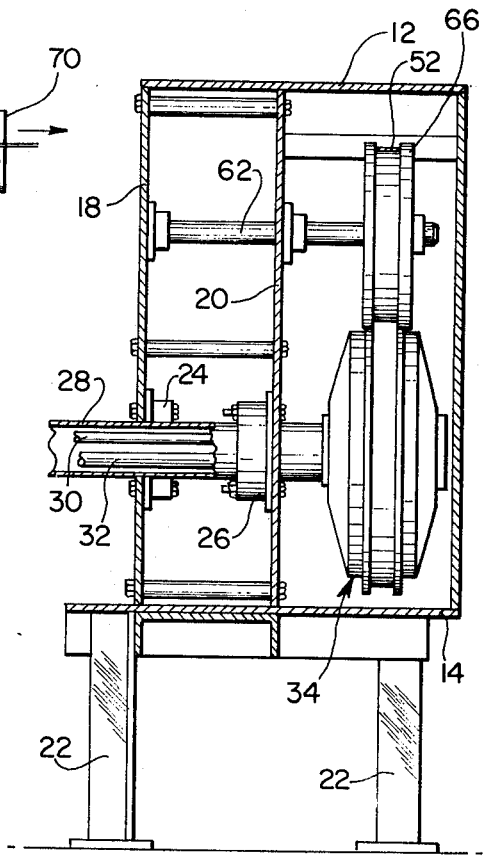
FIG. 2 is a section taken on line 2—2 of FIG. 1.

Referring now to the drawings, a housing is shown generally at 10 comprising a top wall 12, a bottom wall 14, front wall 16, rear wall 18, and intermediate wall 20. Supporting legs 22 are secured to bottom wall 14 by any suitable means.

Figure 4:
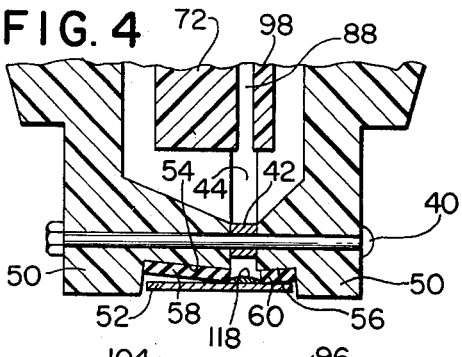
FIG. 4 is an enlarged fragmentary sectional view showing the end of the suction chamber.
Figure 5:
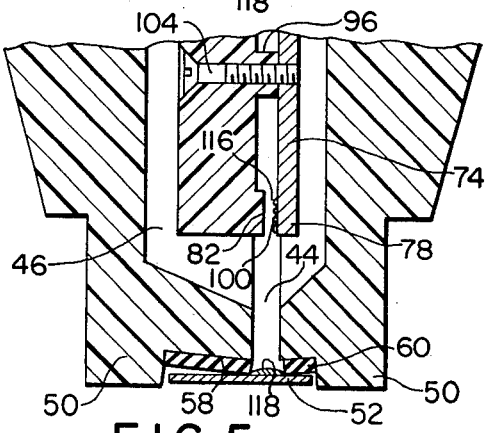
FIG. 5 is an enlarged fragmentary sectional view taken on line 5—5 of FIG. 1.

Fixedly secured to walls 18 and 20, as at 24, 26, is a hollow spindle 28 through which extends a pair of separate conduits 30, 32. Rotatably mounted on the end of spindle 28 is a plating wheel shown generally at 34. Wheel 34 is constructed of separate sections 36, 38, each of which is preferably formed from a lightweight material, such as plastic. As will be seen most clearly in FIGS. 3 through 5, the sections 36, 38 are secured to each other at spaced peripheral points by means of bolts 40, said bolts extending through an intermediate spacer 42, which spacers maintain the sections 36 and 38 spaced from each other so as to define a peripheral slot 44. It will also be noted that when the sections 36, 38 are secured to each other, they define an annular hollow interior space 46. As previously stated, wheel 34 is freely rotatable around spindle 28 and is maintained properly positioned with respect thereto by virtue of the fact that the sections 36, 38 engage opposite sides of hub 48 carried by said spindle.

The periphery of wheel 34 has a pair of spaced shoulders 50 which define therebetween a trackway for receiving the metal strip 52 to be plated. More specifically, as will be seen most clearly in FIGS. 4 and 5, the outer peripheral surfaces 54 and 56 of sections 36, 38, respectively, are angularly disposed, or, expressed differently, taper inwardly from the opposite outer edges of slot 44 whereby the inner surface of strip 52 will make line engagement with said opposite slot edges in order to effect a more secure seal at said locations. Actually, rubber-like gasket strips 58, 60 are secured to surfaces 54, 56, respectively, whereby the inner surface of strip 52 actually engages said gasket strips. It has been found that by inclining the surfaces 54, 56 as illustrated, a better-defined and more secure seal exists between strip 52 and the opposite sides of slot 44, this more finite seal being important for reasons hereinafter to be explained.

Rotatably mounted on shafts 62, 64 carried by walls 18 and 20 are idler rollers 66, 68, respectively. As will be seen most clearly in FIG. 1, strip 52 engages idler roller 66 and then extends around wheel 34, and then extends upwardly around roller 68 and exits from housing 10 through guide rollers 70. It will be understood that any suitable means (not shown) are provided for diving the strip 52 and for back tensioning means so that the engagement of said strip with wheel 34 will impart corresponding rotation to the latter.

Figure 3:
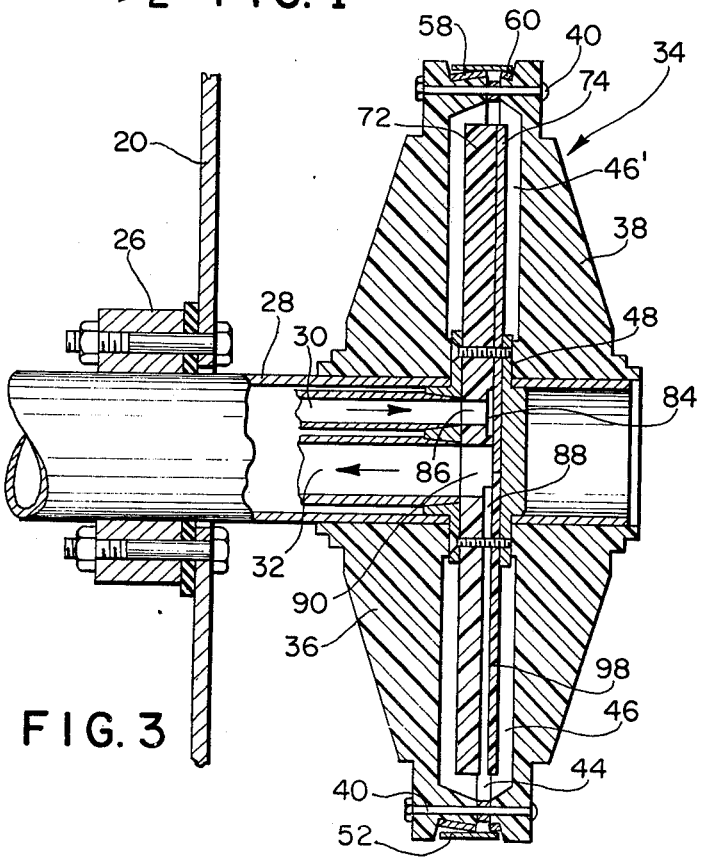
FIG. 3 is a section on line 3—3 of FIG. 1.
Figure 6:
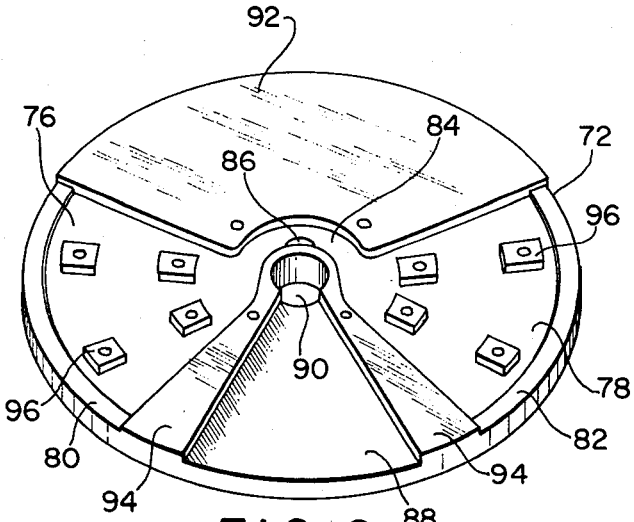
FIG. 6 is a perspective view of one of the distributor discs which form a part of the present invention.
Figure 7:
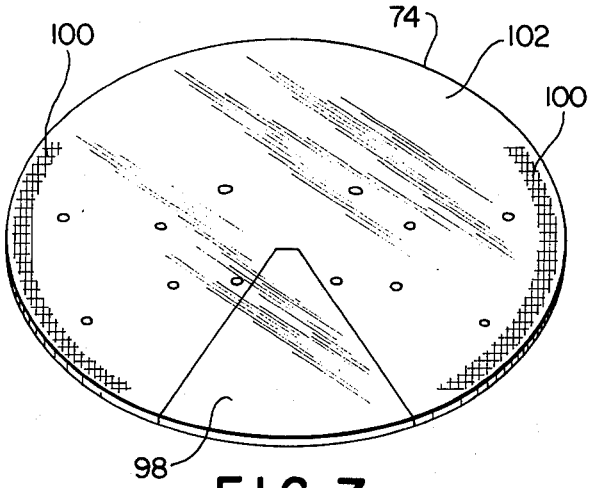
FIG. 7 is a perspective view of the other distributor disc.

Fixedly secured to hub 48, and hence to spindle 28, are a pair of discs 72, 74, see FIGS. 3, 6 and 7. Disc 72 is preferably of integral, unitary plastic construction and has a pair of oppositely disposed chambers 76, 78 formed therein, said chambers having peripheral flanges or ledges 80, 82, respectively. As will be seen most clearly in FIG. 6, the chambers 76, 78 have a central communicating portion 84 which in turn has an opening 86 extending therethrough. Chamber 76 preferably spans approximately a 7 to 10 o'clock position, while chamber 78 spans approximately a 2 to 5 o'clock position with respect to disc 72. A further radially extending chamber 88 is formed in disc 72, the chamber 88 communicating with a central opening 90. It will be understood that the depth of chambers 76, 78 and 88 is approximately the same; although the chamber 88 does not have a peripheral flange corresponding to the flanges 80, 82 in the chambers 76, 78, respectively. The top surface of disc 72 is actually the surface defined by portion 92 and the portions 94. said portions 94 functioning to separate the chamber 88 from adjacent chambers 76 and 78. Likewise, the top surface of spacing bosses 96 is in the same plane as the top surfaces of portions 92 and 94.

Disc 74 is preferably constructed of an electrolytically conductive metal, such as titanium, with the exception of section 98, which is a nonconductive insert, such as plastic. Conversely, the disc 74 could be made of plastic if suitable anode means were associated therewith where plating takes place, although a metallic material such as titanium is preferred since it is less likely to be affected by the high temperatures that may be encountered. It will be understood that the section 98 is adapted to align with chamber 88 when the discs 72 and 74 are secured to each other. Disc 74 is further characterized by the provision of a pair of anode mesh members 100, each of which is secured, by any suitable means, to face 102 of disc 74 adjacent the periphery thereof and in a position which corresponds to the location of chambers 76, 78. More specifically, when plate 74 is secured to plate 72, as by screws 104 extending through bosses 96 (see FIG. 5), the surface 102 of plate 74 is in abutting, face-to-face relation with the surface of portions 92, 94 and 96 of disc 72. When so assembled, nonconductive plastic section 98 overlies chamber 88 while the anode mesh members 100 are positioned adjacent the open ends of chambers 76, 78. As previously stated, and as will be seen most clearly in FIG. 3, the assembled discs 72, 74 are fixedly secured to spindle 28 and hence are held against rotation. Expressed differently, wheel 34 rotates around the fixed discs 72, 74, it being noted that said discs extend into the hollow annular portion 46 of wheel 34, it being further noted that the diameter of discs 72, 74 is somewhat less than the diameter of wheel 34. When the discs 72, 74 are fixedly secured to spindle 28, conduit 30 aligns and communicates with opening 86, while conduit 32 aligns and communicates with opening 90.

Figure 10:
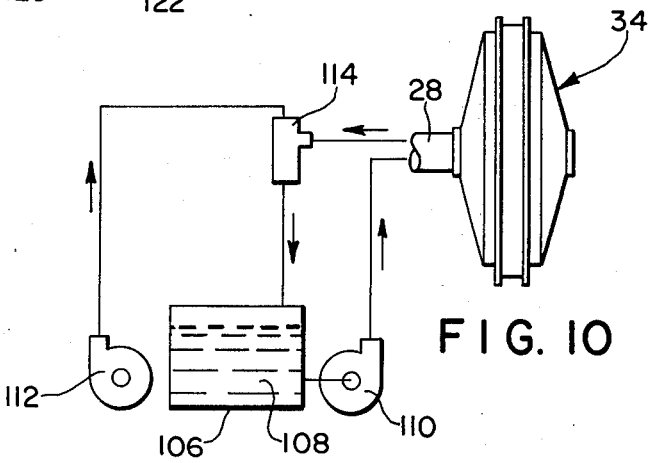
FIG. 10 is a diagram illustrating the electrolyte flow circuit embodied in the present invention.
Figure 11:
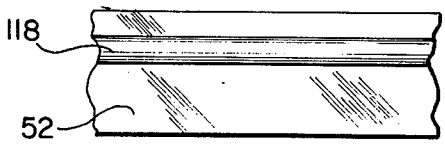
FIG. 11 is a fragmentary plan view of a metal strip plated in accordance with the present invention.

As shown schematically in FIG. 10, a reservoir 106 is provided with a supply of electrolyte fluid 108. The electrolyte is pumped from the reservoir 106 by means of pump 110 to conduit 30 whereby it is introduced under pressure through opening 86 to the chambers 76, 78. Thus, the conduit 30 is actually a feed conduit. On the other hand, conduit 32 is connected to a suction pump 112 connected to Venturi 114 to impart a negative pressure through opening 90 to chamber 88. Thus, the chamber 88 is actually a suction chamber, whereas the chambers 76, 78 are electrolysis chambers, the operation of which will now be described.

As above stated, the electrolyte liquid is pumped under pressure through conduit 30, through opening 86, to chambers 76, 78. The electrolyte is forced radially outward through the chambers 76, 78, through the space 116 (FIG. 5) defined by flanges 80, 82, and plate 74, and then outwardly through slot 44 into engagement with the exposed inner surface of strip 52, and more specifically, that portion of the inner surface of strip 52 located between the inner edges of gasket strips 58, 60. The disc 74, preferably being constructed of an electrolytically conductive material, such as titanium, functions as an anode by means of any suitable connection (not shown) to a source of current. The anode mesh 100 enhances the anode side of the circuit, while the strip 52 is connected by any suitable means (not shown) to a source of electric current, preferably at a location close to wheel 34, so as to create the cathode side of the circuit. The flow of electrolyte through the chambers 76, 78 completes the circuit and causes a stripe 118 to be plated on strip 52, all in a manner well known in the art. After the electrolyte liquid flows out of the open ends of chambers 76, 78, it is immediately drawn along the peripheral edge of discs 72, 74 to chamber 88 because of the negative pressure which exists in chamber 88. This action is enhanced by the fact that the chamber 88 is located at the bottom of wheel 34, i.e., approximately the 5 to 7 o'clock position thereof, whereby the flow of electrolyte liquid to the chamber 88 will be enhanced by gravity. The constant suction applied to chamber 88 continuously draws off the electrolyte which then exits through conduit 32 and returns to reservoir 106 for subsequent recirculation through conduit 30 by means of pump 110. It is important to note that no plating of strip 52 takes place at chamber 88, since there is no anode at this location. It is for this reason that the insulating section 98 has been inserted, since it is specifically desired that no plating take place at this location. The reason for this is that this is the one location where a standing pool of electrolyte may form; and one of the objectives of the present invention is to avoid plating through such a standing pool. On the other hand, no standing pool of electrolyte will ever form adjacent chambers 76, 78, since the excess electrolyte will immediately be drawn to chamber 88 by the negative pressure which exists at said location and also by gravity, as hereinbefore explained. This arrangement permits a more rapid rate of plating to be effectively achieved by the present apparatus, as compared to the prior art, where plating normally takes place through a standing pool of electrolyte. In addition, the fact that the electrolyte is constantly being drawn off by suction means enables the rate of flow of electrolyte into plating wheel 34 to be increased, whereby a greater exchange of electrolyte is constantly taking place in the system than is true where the electrolyte is being introduced by gravity, rather than by being pumped in, and wherein removal of the electrolyte is likewise by gravity. This greater exchange of electrolyte in the system also enables effective plating to be achieved at a substantially faster rate.

It has been found that by inclining the surfaces 54, 56 at the opposite sides of slot 44, a far superior contact with strip 52 is achieved. More specifically, since the present invention involves a suction system, it is obviously important that the strip 52 make a tight seal with the periphery of wheel 34 so as to tightly close off slot 44. By tapering the surfaces 54, 56, a superior seal is obtained, which also contributes to more precise definition of the plated stripe 118. The specific inclination used will be determined by the thickness of strip being plated, the depth of the stripe to be plated etc., and will normally be somewhere between 0° and 20°.

Figure 8:
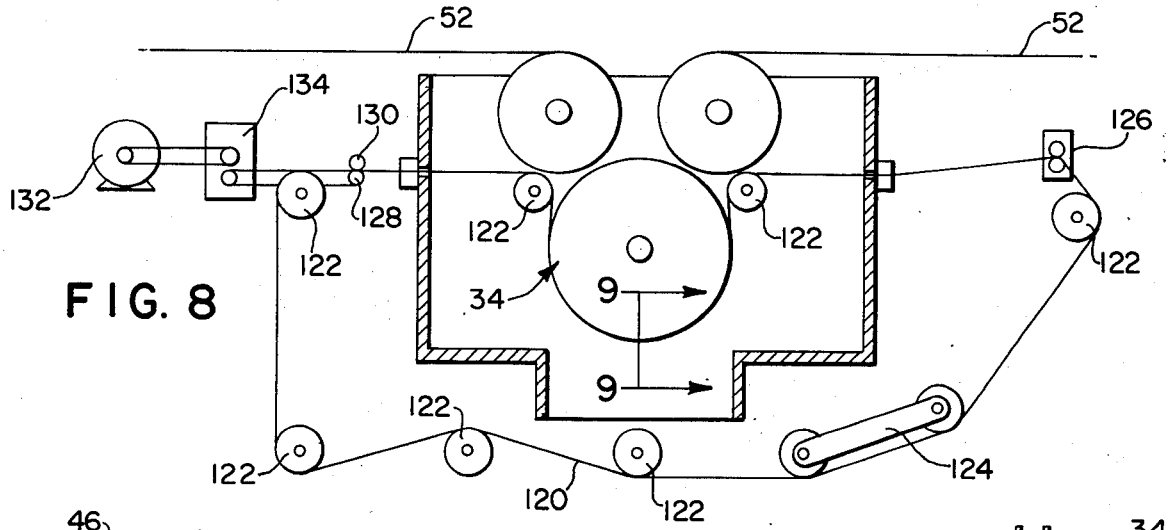
FIG. 8 is a schematic view showing the auxiliary belt system which forms a part of this invention.
Figure 9:
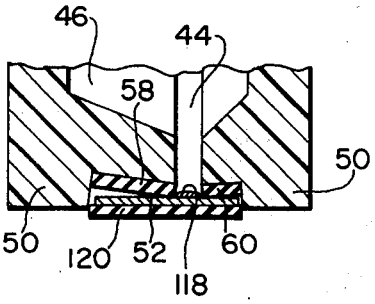
FIG. 9 is a section taken on line 9—9 of FIG. 8.

In some cases it has been found that where the strip 52 is extremely thin, it may not be possible to provide sufficient back tension on the strip so as to insure a tight seal with the periphery of wheel 34. In such a situation, it has been found that an auxiliary belt system, such as shown in FIG. 8, overcomes this problem. More specifically, a belt 120, preferably of a suitable rubber material, extends around a plurality of idler rollers 122 into driving engagement with the outer surface of strip 52. Gravity tension means 124 maintain sufficient tautness in belt 120, while a back tension device 126 maintains controlled tension of that part of the belt which is engaging wheel 34. A pair of pinch rolls 128, 130 actually drive the belt 120, the roll 128 being driven by motor 132, there being a slip clutch 134 interposed between motor 132 and driven roll 128, said clutch functioning to automatically synchronize the speed of movement of belt 120 to conform to the speed of movement of strip 52. As stated, belt 120 in the system shown in FIG. 8 is utilized where strip 52 is not thick enough so as to carry sufficient back tension to insure a good seal with the periphery of wheel 34. The same problem may arise where the strip 52 is unusually thick, in which case it may not be sufficiently flexible to closely conform to the periphery of wheel 34, in which situation the auxiliary belt system of FIG. 8 would again be used to insure a tight seal between the strip 52 and wheel 34.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Continuous selective plating apparatus for electroplating metal on a metallic strip, said apparatus comprising a rotatably mounted hollow wheel having a slot extending around the periphery thereof, said slot communicating with the hollow interior of said wheel, means for maintaining a metal strip to be plated in engagement against a portion of the periphery of said wheel whereby the aforesaid slot for said peripheral portion is sealed closed by said strip, means for advancing said strip and rotating said wheel, fixed, nonrotatable distribution means mounted within said wheel comprising electrolysis and suction chambers extending radially toward, but terminating short of, said peripheral wheel portion, said chambers being open at their outer ends, means for continuously feeding an electrolyte to said electrolysis chamber and forcing same outwardly therethrough into contact with the adjacent exposed inner surface of said strip, anode means associated with said electrolysis chamber, said strip being connected as a cathode, whereby the inner surface of the strip contacted by the electrolyte is electroplated, means for imparting a negative pressure to said suction chamber, whereby excess electrolyte from said electrolysis chamber is continuously drawn into the open end of said suction chamber and then is evacuated from the apparatus, said suction chamber having no anode means whereby no appreciable plating of the strip takes place at that location, said wheel being vertically disposed, said suction chamber extending downwardly and said electrolysis chamber being located in juxtaposition to said suction chamber.

2. In the apparatus of claim 1, said suction chamber spanning approximately the 5 to 7 o'clock position thereof, said electrolysis chamber spanning approximately the 2 to 5 or 7 to 10 o'clock position thereof.

3. In the apparatus of claim 2, there being a second electrolysis chamber of approximately the same size as said first electrolysis chamber, said second chamber being located in juxtaposition to said suction chamber on the opposite side thereof from said first chamber.

4. In the apparatus of claim 1, said wheel being rotatably mounted on a fixed hollow spindle and said distribution means being fixedly secured to said spindle, said spindle having a pair of conduits extending therethrough, one of said conduits communicating with said electrolysis chamber for feeding electrolyte thereto, and the other conduit communicating with said suction chamber for applying the negative pressure thereto.

5. In the apparatus of claim 4, means for recirculating the electrolyte drawn off through the suction conduit back through the feed conduit to the electrolysis chamber.

6. In the apparatus of claim 1, the outer periphery of said wheel tapering away from opposite sides of said slot, whereby said strip makes line contact with opposite edges of said slot, thus effecting a tighter seal with said opposite edges.

7. In the apparatus of claim 1, belt means making driving engagement with the outer surface of said peripheral wheel portion whereby the strip is sandwiched between said peripheral wheel portion and said belt means, independent means driving said belt means, and means associated with said independent drive means for synchronizing the speed of movement of said belt means with the speed of movement of said strip.

8. Continuous selective plating apparatus for electroplating metal on a metallic strip, said apparatus comprising a rotatably mounted hollow wheel having a slot extending around the periphery thereof, said slot communicating with the hollow interior of said wheel, means for maintaining a metal strip to be plated in engagement against a portion of the periphery of said wheel whereby the aforesaid slot for said peripheral portion is sealed closed by said strip, means for advancing said strip and rotating said wheel, fixed, nonrotatable distribution means mounted within said wheel comprising electrolysis and suction chambers extending radially toward, but terminating short of, said peripheral wheel portion, said chambers being open at their outer ends, means for continuously feeding an electrolyte to said electrolysis chamber and forcing same outwardly therethrough into contact with the adjacent exposed inner surface of said strip, anode means associated with said electrolysis chamber, said strip being connected as a cathode, whereby the inner surface of the strip contacted by the electrolyte is electroplated, means for imparting a negative pressure to said suction chamber, whereby excess electrolyte from said electrolysis chamber is continuously drawn into the open end of said suction chamber and then is evacuated from the apparatus, said suction chamber having no adode means whereby no appreciable plating of the strip takes place at that location, said distribution means comprising a pair of concentrically mounted, generally circular discs secured to each other in face-to-face contact, said discs being of lesser diameter than said wheel, said chambers being formed at the interface of said discs, at least one of said discs being constructed of an electrolytically conductive metal, except at the area defining said suction chamber, at which area at least one of said discs is constructed of nonconductive material.

9. In the apparatus of claim 8, said anode means further comprising a separate anode member secured to said one disc at the inner face thereof adjacent its periphery, said member extending for the width of said electrolysis chamber.

* * * * *